US007787793B2

(12) United States Patent
Thayer et al.

(10) Patent No.: US 7,787,793 B2
(45) Date of Patent: Aug. 31, 2010

(54) METHOD FOR ADJUSTING CLEANING BLADE LOAD ON A PHOTORECEPTOR

(75) Inventors: Bruce E Thayer, Webster, NY (US); Richard W Seyfried, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 218 days.

(21) Appl. No.: 12/136,086

(22) Filed: Jun. 10, 2008

(65) Prior Publication Data

US 2009/0304406 A1 Dec. 10, 2009

(51) Int. Cl.
*G03G 15/00* (2006.01)

(52) U.S. Cl. ..... 399/71; 399/123

(58) Field of Classification Search ..... 399/38, 399/71, 110, 111, 123, 343, 350, 351; 15/256.5, 15/256.51, 256.52
See application file for complete search history.

(56) References Cited

U.S. PATENT DOCUMENTS 5,208,639 A 5/1993 Thayer et al.

5,600,425 A * 2/1997 Thayer et al. ..... 399/353

OTHER PUBLICATIONS

U.S. Appl. No. 11/877,770, filed Oct. 24, 2007 and entitled Long Life Cleaning System With Replacement Blades by Bruce E. Thayer et al.
U.S. Appl. No. 12/021,500, filed Jan. 29, 2008 and entitled Dual Blade Cleaning System by Bruce E. Thayer et al.
U.S. Appl. No. 12/136,087, filed Jun. 10, 2008 and entitled Variable Interference Cleaning Blade Method by Bruce E. Thayer et al.
U.S. Appl. No. 12/136,088, filed Jun. 10, 2008 and entitled Cleaning Method for Compensating for Environmental Conditions and Blade Age in a Cleaning Subsystem by Bruce E. Thayer et al.

* cited by examiner

*Primary Examiner*—Hoan Tran

(57) ABSTRACT

A method for controlling a xerographic single or multiple blade cleaning subsystem includes sensing the actual cleaning blade load against a photoreceptor with a transducer and adjusting it to a desired value. A feedback loop through a stepper motor will set the desired load by changing blade to photoreceptor interference. This will correct for the effects of piece part tolerances, blade modulus changes with environment and set with age. A single transducer and positioning system can achieve the desired average blade load, or one at each end can also keep the load even from end to end.

20 Claims, 6 Drawing Sheets

METHOD FOR ADJUSTING CLEANING BLADE LOAD ON A PHOTORECEPTOR

CROSS-REFERENCE TO RELATED APPLICATIONS

Cross referenced is copending and commonly assigned U.S. application Ser. No. 11/877,770, filed Oct. 24, 2007 and entitled LONG LIFE CLEANING SYSTEM WITH REPLACEMENT BLADES by Bruce E. Thayer et al., now U.S. Publication No. 20090110416; published Apr. 30, 2009; U.S. application Ser. No. 12/021,500, filed Jan. 29, 2008 and entitled DUAL BLADE CLEANING SYSTEM by Bruce E. Thayer et al., now U.S. Publication No. 20090190975, published Jul. 30, 2009; U.S. application Ser. No. 12/136,087, filed Jun. 10, 2008 and entitled VARIABLE INTERFERENCE CLEANING BLADE METHOD by Bruce E. Thayer et al., now U.S. Publication No. 20090304407, published Dec. 10, 2009; and U.S. application Ser. No. 12/136,088, filed Jun. 10, 2008 and entitled CLEANING METHOD FOR COMPENSATING FOR ENVIRONMENTAL CONDITIONS AND BLADE AGE IN A CLEANING SUBSYSTEM by Bruce E. Thayer et al., now U.S. Publication No. 20090304402, published Dec. 10, 2009, all of which are included in their entirety herein by reference.

BACKGROUND

1. Field of the Disclosure

This disclosure relates to an electrostatographic printing system that employs an imaging device, and more particularly, to cleaning residual toner from a charge retentive surface of the imaging device.

2. Description of Related Art

Electrostatographic machines including printers and copiers form a latent image on the surface of photosensitive material which is identical with an original image, brings toner-dispersed developer into contact with the surface of the photosensitive material, and sticks toner particles only onto the latent image with electrostatic force to form a copied image on a copy sheet. Thus, a toner image is produced in conformity with the original image. The toner image is then transferred to a substrate and the image affixed thereto to form a permanent record of the image to be produced. Although a preponderance of the toner forming the image is transferred to the substrate during transfer, some toner invariably remains on the charge retentive surface of the photosensitive material, it being held thereto by relatively high electrostatic and/or mechanical forces. Additionally, paper fibers, toner additives, kaolins and other debris have a tendency to be attracted to the charge retentive surface. It is essential for optimal imaging that the toner and debris remaining on the charge retentive surface be cleaned therefrom for quality images to be produced by the machines.

"Blade cleaning" is a technique for removing toner and debris from a photoreceptor. In a typical application as disclosed in U.S. Pat. No. 5,208,639 which is included herein by reference, a relatively thin elastomeric blade member is supported adjacent to and transversely across the photoreceptor surface with a blade edge that chisels or wipes toner from the surface. Toner accumulating adjacent to the blade is transported away from the blade area by a toner transport arrangement or by gravity. Blade cleaning is advantageous over other cleaning systems due to its low cost, small cleaner unit size, low power requirements, and simplicity. However, conventional blade cleaning systems suffer from short life due to early, random failures. Attempts to identify blade materials that possess better reliability and enable dramatic life improvements have not been successful. Introduction of additional blade lubrication can significantly improve blade reliability and life, but adverse interactions with other xerographic systems frequently occur. The introduction of photoreceptor surface coatings has improved photoreceptor life, but these coatings typically result in far higher blade wear rates. Improvements from the introduction of additional lubrication are typically more than offset by the use of coated photoreceptors.

Cleaning blades perform best and last the longest when they are uniformly loaded to the desired blade load. Part tolerances typically require that the blade be loaded higher than desired in order to guarantee that the minimum blade load is larger than that required for better cleaning over the expected life of the blade. The higher blade load increases blade wear and shortens blade life. The cleaning blade, blade holder and blade mounting surfaces are held to high tolerances at increased cost to minimize the variation in blade interference to the photoreceptor. Extra cost is incurred by requiring inspection of the resulting blade load to insure that part manufacture and assembly maintain process control. In some cases each individual blade is set up using optical devices to achieve the desired blade interference. Control of blade load and its uniformity adds cost and reduces life of cleaning blade systems.

Accordingly, there is an unmet need for systems and/or methods that facilitate overcoming the aforementioned deficiencies.

SUMMARY

In accordance with various aspects described herein, a method is disclosed for sensing blade load and adjusting blade interference to obtain a desired blade load including sensing the blade load with a transducer and using a stepper motor to increase or decrease interference of the blade to the photoreceptor surface. A single transducer will provide an average blade load over the length of the blade. The stepper motor adjusts blade interference through movement of the blade until blade load sensed by the transducer matches a predetermined value. If stepper motors and transducers are located on each end of the blade, then the blade can be aligned to the photoreceptor by adjusting interference at each end of the blade to one half the predetermined total blade load value. The transducer and stepper motor can also be used to compensate for relaxation of the blade material over time and changes in material modulus with environmental changes in temperature and humidity.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
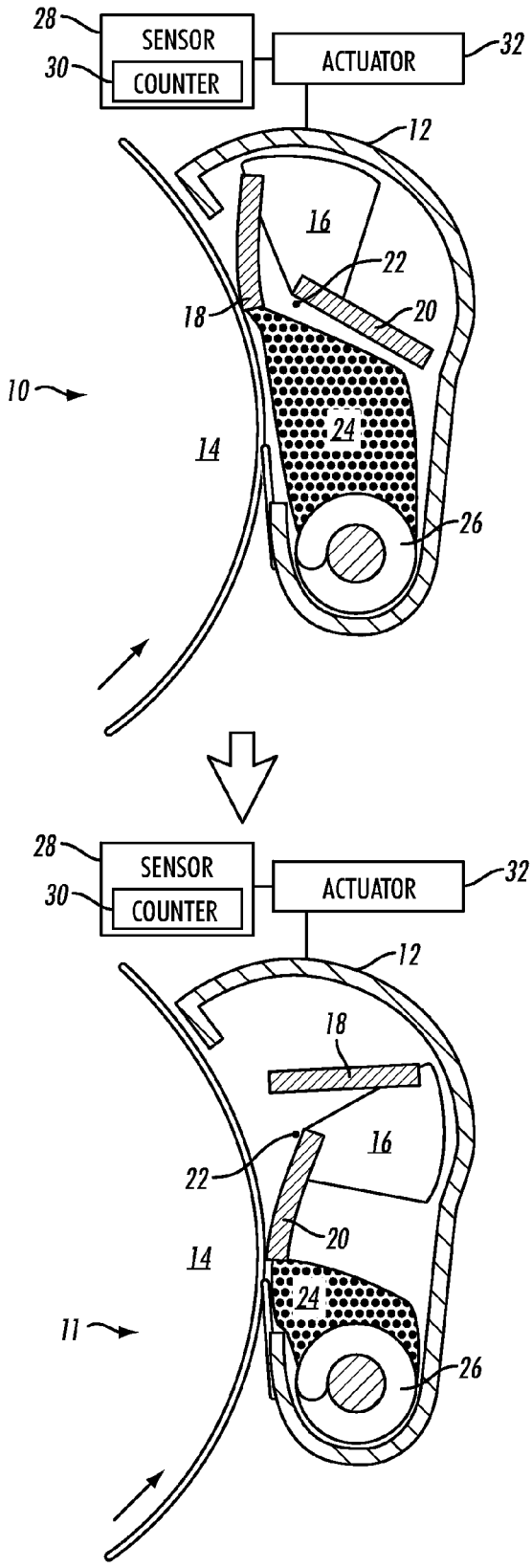
FIG. 1 is a side view of a cleaning system that enables blade cleaning performance sensing and adjustment of blade to photoreceptor interference.

With reference to FIG. 1, a system is illustrated that facilitates replacing a used cleaning blade with a cleaning blade at the end-of-life (EOL) of the used cleaning blade, or at any other desired replacement time while simultaneously adjusting blade interference to provide the minimum load high quality cleaning. The system is illustrated in a first orientation 10 wherein the first cleaning blade is in use, and in a second orientation 11, wherein the second cleaning blade is in use. The system comprises a cleaner unit 12, that is in operational contact with a photoreceptor 14, and houses a blade holder 16, which in turn has a first blade 18 and a second blade 20 attached thereto. The blade holder 16 pivots about a pivot point 22 to position the first or second blade against the surface of the photoreceptor 14, which has a direction of rotation indicated by the arrow at the bottom of the photoreceptor 14 (e.g., counterclockwise in this example). The blade, when placed against the surface of the photoreceptor 14, removes excess waste toner 24, which is directed toward a toner removal auger 26 that removes the waste toner 24 from the cleaner unit 12. Waste toner 24 may then be discarded, recycled, etc.

The system further comprises a sensor 28 that senses status information related to print quality, toner build-up, blade wear, or any other suitable parameter for determining an appropriate time for switching blades. The sensor can comprise one or more counters 30 that facilitate determining when to change a blade. An actuator 32 performs the blade change, and may be manual (e.g., a knob, lever, cam, or other actuating means that an operator manipulates to effectuate the blade change) or automatic (e.g., a motor, solenoid, etc.) that changes the blade in response to a sensed blade change condition.

Thus, the system comprises a compact cleaning blade unit having two or more blades that are positioned so that toner flow is not impeded and so that accumulated toner does not apply pressure to the operating blade. Simple rotation of the blade holder removes a used blade and replaces it with a new blade. The photoreceptor surface can be stationary or moving backwards from normal operation during blade replacement. The sensor 28 detects accumulated blade use in one or more ways. For instance, the counter 30 can measure blade use as a function of a number of prints and/or as a function of photoreceptor cycles.

Figure 2:
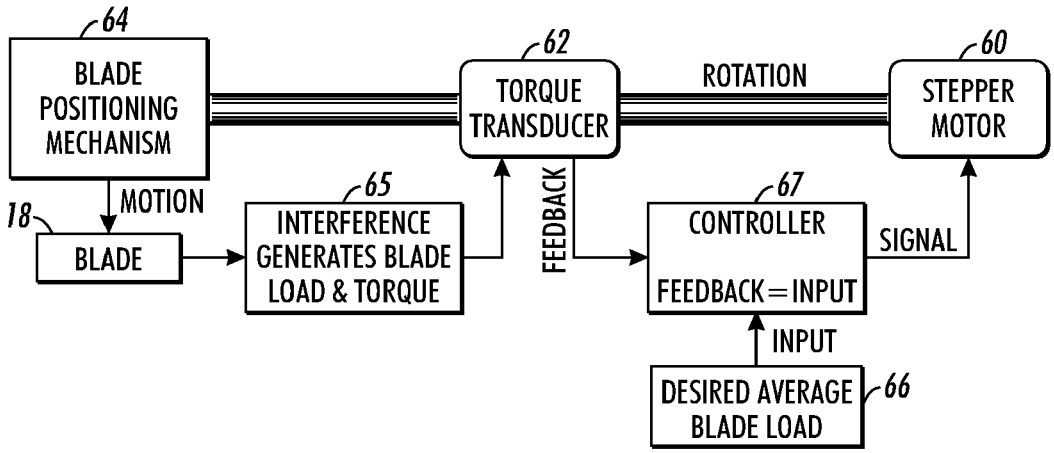
FIG. 2 is a schematic of a single torque transducer system used to control average blade load to the minimum required for cleaning.

In accordance with one aspect of the present disclosure and as disclosed in FIG. 2, rotation of blade 18 through blade positioning mechanism 64, which could be a rack and pinion or lead screw drive or other conventional mechanism, controls the amount of interference for each blade in the assembly. By controlling the amount of rotation, the blade load can be varied. A stepper motor 60 is drivingly connected to blade positioning mechanism 64 and thereby blade holder 16 and blade 18 and used to provide rotation of blade 18 in defined increments. Interference against the photoreceptor generates blade load and torque in block 65. By measuring this torque with torque transducer 62 that is positioned between stepper motor 60 and blade positioning mechanism 54, the blade load is determined. A signal is sent from torque transducer 62 to controller 67 and the controller then signals stepper motor 60 to rotate the blade holder until the measured output of the torque transducer indicates that the previously inputted desired average blade load from block 66 has been achieved.

Figure 3:
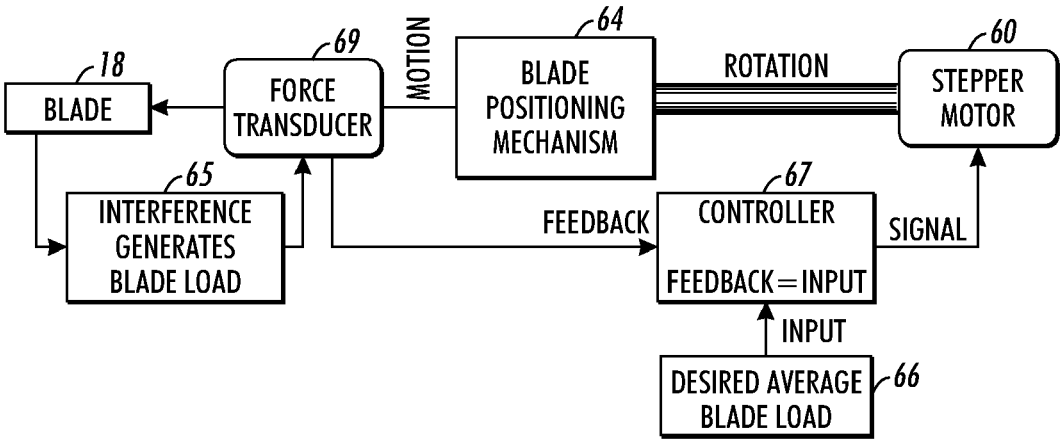
FIG. 3 is a schematic of a single force transducer system used to control average blade load to the minimum required for cleaning.

Alternatively, with like reference characters designating corresponding parts in FIGS. 2 and 3, a force transducer 69 is shown in FIG. 3 positioned between blade positioning mechanism 64 and blade 18 in order to control the amount of force applied to the photoreceptor for each blade in the assembly. By controlling the amount of force, the blade load can be varied. A stepper motor 60 is drivingly connected to blade positioning mechanism 64 and thereby blade holder 16 and blade 18 and used to provide rotation of blade 18 in defined increments. Force transducer 69 is connected to blade 18 and gives a direct measurement of blade load against the photoreceptor generates blade load and torque in block 65. By measuring this force with force transducer 69, the blade load is determined. A signal is sent from force transducer 69 to controller 67 and the controller then signals stepper motor 60 to rotate the blade holder until the measured output of the force transducer indicates that the previously inputted desired average blade load from block 66 has been achieved.

Any misalignment of the blade holder axis to the photoreceptor surface will result in a variation in blade load from the inboard and outboard ends of the blade. Because the blade holder is a rigid member, both inboard and outboard ends of the blade holder 16 will rotate the same mount. This configuration, with a transducer to measure the blade load, is capable of adjusting blade load to a desired average value. It is also capable of adjusting blade load over time to compensate for blade set that otherwise would result in a loss of blade load due to blade material relaxation under prolonged strain. Similarly, changes in blade material modulus due to environmental changes in humidity and temperature can be compensated for by changing interference. Blade material responses to relaxation or environmental conditions do not need to be characterized since blade load is directly measured and controlled. Controlling blade load directly removes relaxation and environmental considerations as constraints on blade selection.

Figure 4:
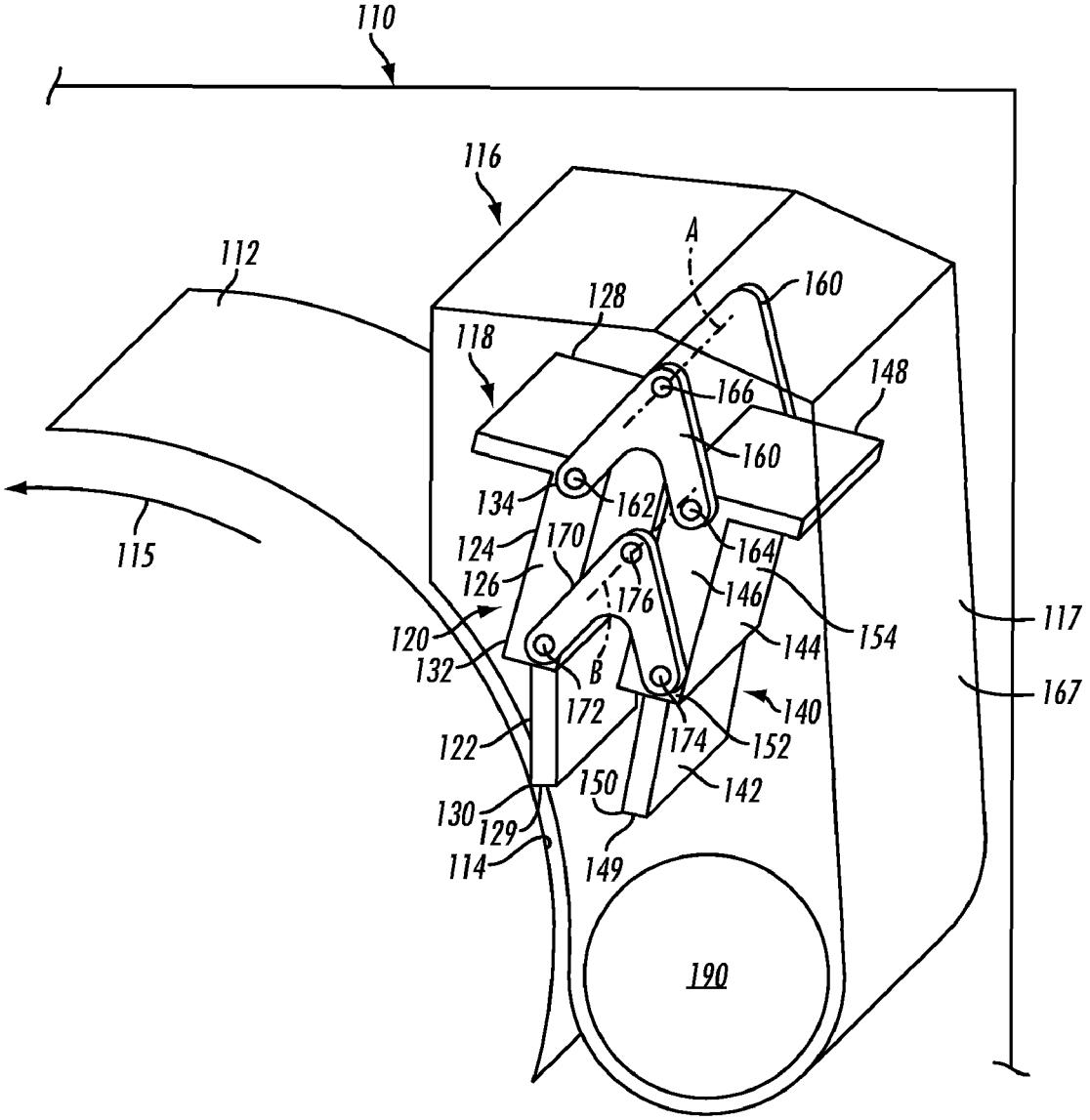
FIG. 4 is a perspective view illustrating an alternative two blade cleaning system having a doctor blade arrangement as described herein with a first cleaning blade disposed in the cleaning position.

An alternative two blade cleaning system is shown in FIG. 4 where an image forming device is shown generally at 110. The image forming device 110 can be a copier, such as a xerographic copier, a printer, multifunction device or other device having a photoreceptor 112 for forming an image on a substrate such as for example paper (not shown), having a moving surface 114 which moves in an operational direction shown generally by arrow 115.

The image forming device 110 includes a cleaning system, shown generally at 116, for cleaning toner particles, residue and other materials from a moving photoreceptor surface 114. Though some examples provided describe a system for cleaning moving photoreceptor surfaces 114, the system 116 can also clean other image forming device moving surfaces, including but not limited to moving transfer surfaces such as biased transfer belts, biased transfer rolls, or intermediate transfer belts.

The cleaning system 116 can be contained in a removable cartridge housing 117, if so desired, such as for example part of a print cartridge, also referred to a Xerographic Replaceable Unit (XRU). The XRU can be removed from the image forming device 110 and discarded when its useful life has been depleted.

The cleaning system 116 includes a first cleaning blade 120 having a cleaning blade member 122 extending from a blade holder 124 and terminating in an end 129. The blade, when placed against the surface of the photoreceptor 114, removes excess waste toner which is directed toward a toner removal auger 190 that removes the waste toner from the cleaner unit 116. Waste toner may then be discarded, recycled, etc. The cleaning system 116 also includes a second cleaning blade 140 having a cleaning blade member 142 extending from a blade holder 144 and terminating in an end 149. The cleaning blade members 122, 142 can be formed of a compliant material, such as polyurethane, which enable the blade members to bend or deflect when moved into cleaning contact with the moving surface 114.

The cleaning system 116 includes a pair of blade positioning mechanisms or first links 160 formed of a rigid material, such as metal, plastic, composites or the like. The first links 160 are connected to opposite lateral ends of the cleaning blades 120 and 140 to couple the cleaning blades together for moving one blade member into a cleaning position while simultaneously moving the other blade into a corresponding suspended position. The first links 160 are similar, and thus only one first link is shown in detail for the purposes of clarity. The first links 160 include first pivot connections 162 pivotally connected to the distal portions 134 of the oppositely disposed lateral ends 126 and 128 of the first blade holder 124. The first links 160 also include second pivot connections 164 pivotally connected to the distal portions 154 of the lateral ends 146 and 148 of the second blade holder 144. The first links 160 also include third pivot connections 166 pivotally connected to one or more frame members 167, enabling the first links to rotate about a fixed axis A while preventing non-pivoting displacement of the first links with respect to the frame. The frame 167 can be part of the cartridge 117, or a support member attached to the image forming device 110.

The cleaning system 116 also includes a pair of second links 170 formed of a rigid material, such as metal, plastic, composites or the like. The second links 170 are connected to opposite lateral ends of the cleaning blades 120 and 140 to also couple the cleaning blade members together. The second links 170 are similar, and thus only one second link is shown in detail for the purposes of clarity. The second links 170 include first pivot connections 172 pivotally connected to the proximate portions 132 of the oppositely disposed lateral ends 126 and 128 of the second blade holder 124. The second links 170 also include second pivot connection 174 pivotally connected to the proximate portions 152 of the lateral ends 146 and 148 of the second blade holder 144. The second links 170 also include third pivot connections 176 pivotally connected to one or more of the frame members 167, enabling the second links to rotate about a fixed axis B.

The first and second link pivot connections 162, 164, 166, 172, 174, and 176 can be formed by fasteners, such as rivets, bolts or the like extending from the blade holders 124, 144 or frame 167, and through apertures in the first and second links 160, 170, or in other manners which enable relative rotation at the connections. The pivot connections 162, 164 and 166 are disposed in a triangular arrangement on the first links 160, and the pivot connections 172, 174 and 176 are disposed in a triangular arrangement on the second links 170. The first and second links 160, 170 can be V-shaped, each having 2 legs extending from the third pivot connections 166, 176 with the first pivot connections 162, 172 and second pivot connections 164, 174 disposed at the ends thereof, as shown in FIG. 3. Such an arrangement can enable the links to be located close to each other without interfering in their movement. Other examples of the links 160, 170 can have triangular shapes with the pivot connections disposed at the vertices thereof. Other examples of the links can have other shapes.

Figure 5:
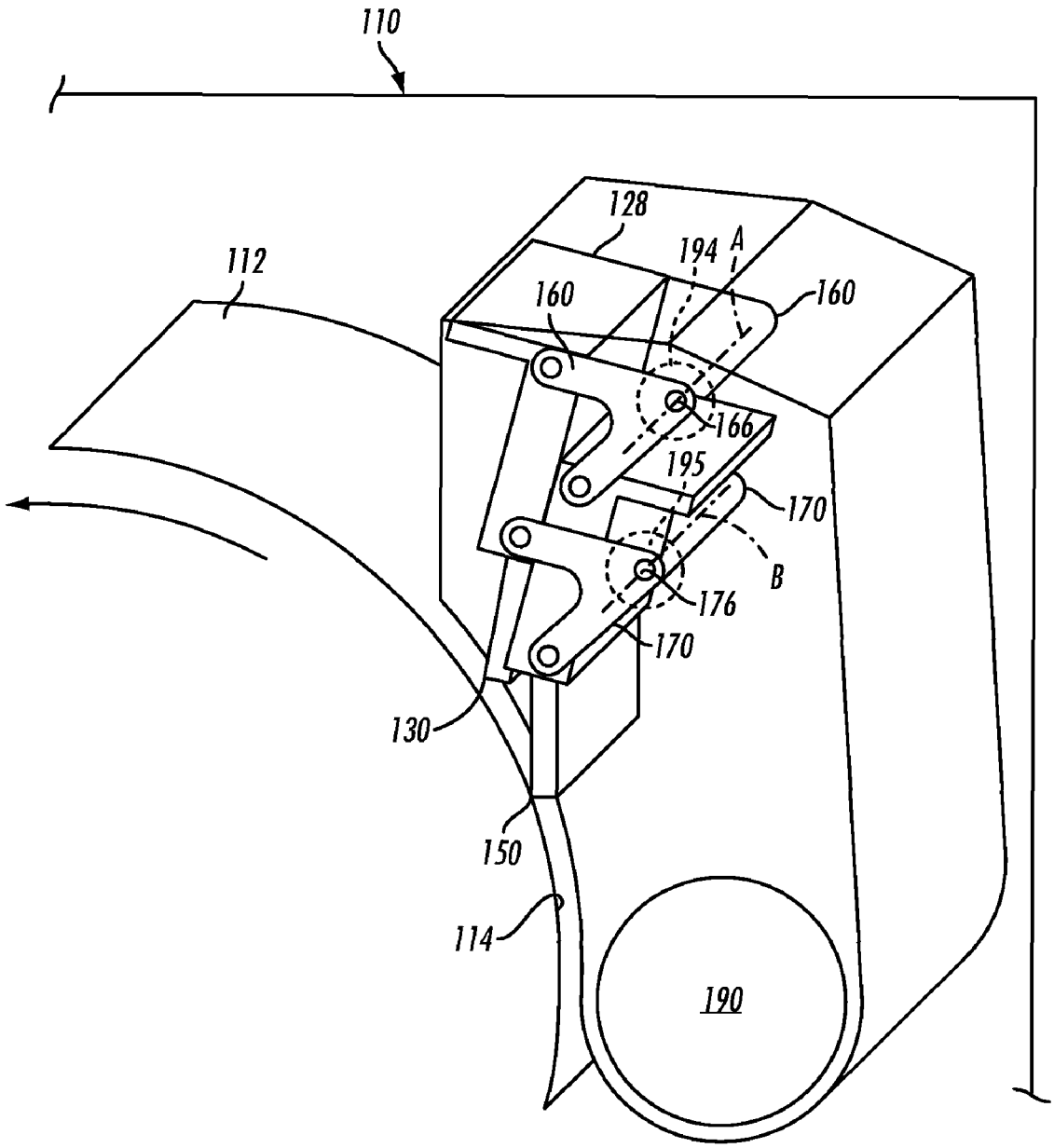
FIG. 5 is a perspective view of the two blade cleaning system of FIG. 3 having a doctor blade arrangement as described herein with a second cleaning blade disposed in the cleaning position.

An actuator 194, as shown in FIG. 5, can be connected to one of the first links 160 to rotate it about the third pivot connection 166. The actuator 194 can be a solenoid, or stepper motor, or some other actuator capable of rotating the first link 160 at connection 166. The actuator 194 can be disposed at the third pivot connection 166, or it can be disposed in another location and connected to the first link 160, such as by gears, arms, etc. so as to provide rotational movement to the first link 160. Other actuator arrangements capable of rotating the first and second links 160 and 170 about the third pivot connections, 166 and 176, respectively, are contemplated including, but not limited to using an actuator, shown at 195, connected to one of the second links 170 to rotate it about the third pivot connection 176, or two actuators 194 connected to each of the first links 160 or two actuators 195 connected to each of the second links 170 for rotating them about the third pivot connections 166 and 176, respectively. The first or second link driven by the actuator 194 or 195, for rotation can be referred to as the drive link, whereas the undriven link can be referred to as the follower link.

A small amount of clearance is intentionally introduced into pivot connections 166 and 176 of blade holders 124 and 144, respectively, in order to be able to vary the interference on one end of the blade slightly from the interference on the other end of the blade. By using this variation and a stepper motor on each end of the blade, independent adjustments of each blade end interference and thus blade load can be obtained. Both inboard and outboard cleaning evaluation toner patches are developed. The stepper motors independently adjust inboard and outboard blade interference until both toner patches are cleaned with the minimum blade load. This procedure aligns the cleaning blade to the photoreceptor based on cleaning performance. The alignment is independent of variability in parts and assembly.

Figure 6:
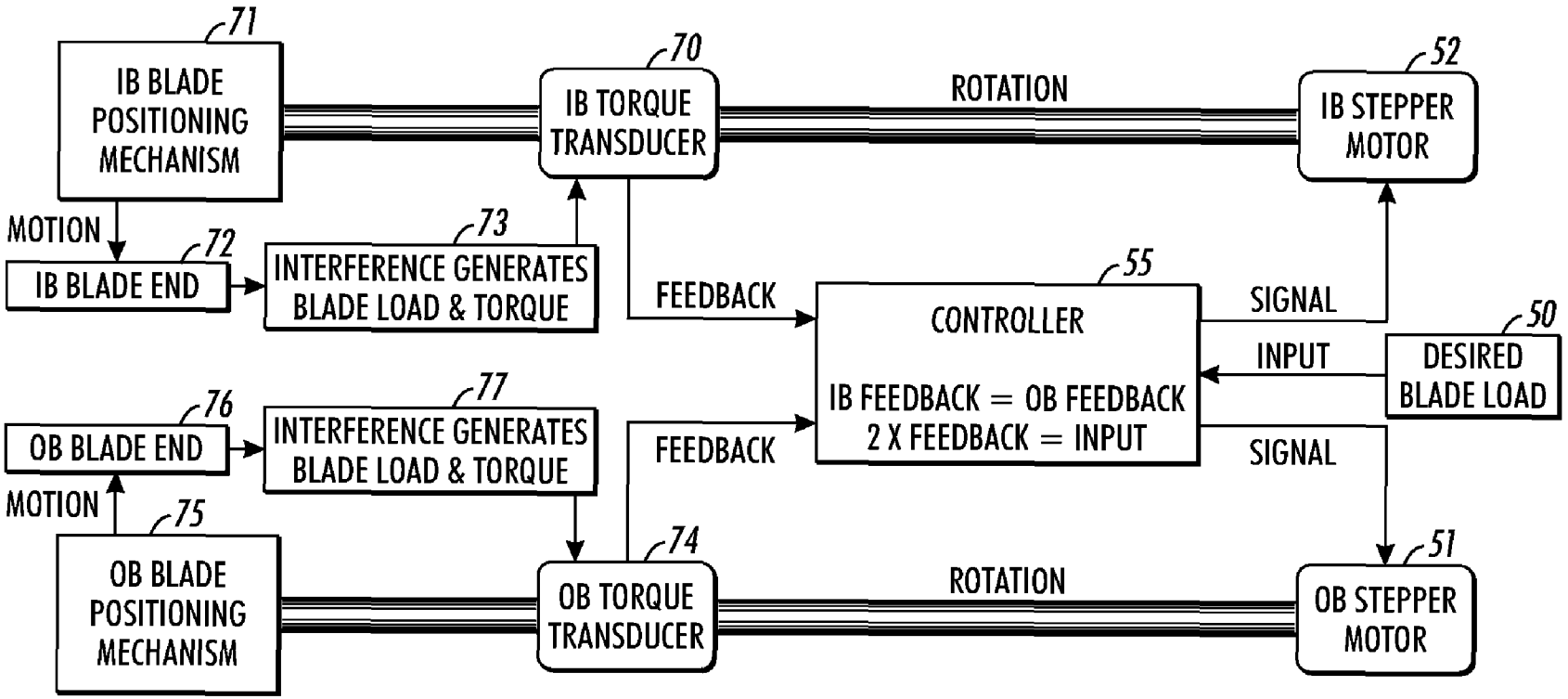
FIG. 6 is a schematic of a two torque transducer system used to control blade load and blade alignment.

A schematic of a cleaning performance control for the cleaning system of FIGS. 4 and 5 is shown in FIG. 6 for controlling blade load and blade alignment where a desired blade load at 50 is inputted into controller 55 which in turn send a signal to stepper motors 51 and 52 operatively connected in this example to link 160 to thereby manipulate cleaning blade 122. Rotation of inboard blade positioning mechanism 71, which in this case is first link 160, by stepper motor 52 provides motion in block 72 to the inboard blade end of blade 122 and interference between the blade and photoreceptor against which the blade is loaded in block 73 generates torque that is transmitted to inboard torque transducer 70 which sends a signal representing the measured torque to controller 55. Simultaneously, rotation of outboard blade positioning mechanism 75, by stepper motor 51 provides motion in block 76 to the outboard blade end of blade 122 and interference between the blade and photoreceptor against which the blade is loaded in block 77 generates torque that is transmitted to outboard torque transducer 74 which sends a signal representing the measured torque to controller 55. As mentioned heretofore, a small amount of clearance is intentionally introduced in the coupler link (blade holder 122) pins in order to be able to vary the interference on one end of the blade slightly from interference on the other end of the blade. By using this variation and a stepper motor and transducer on each end of the blade, independent adjustments of each blade end interference and thus blade load can be obtained. By independently adjusting the blade load measured by the two transducers to half the predetermined blade load value the desired blade load is achieved and the blade is aligned to the photoreceptor surface by controller 55.

Figure 7:
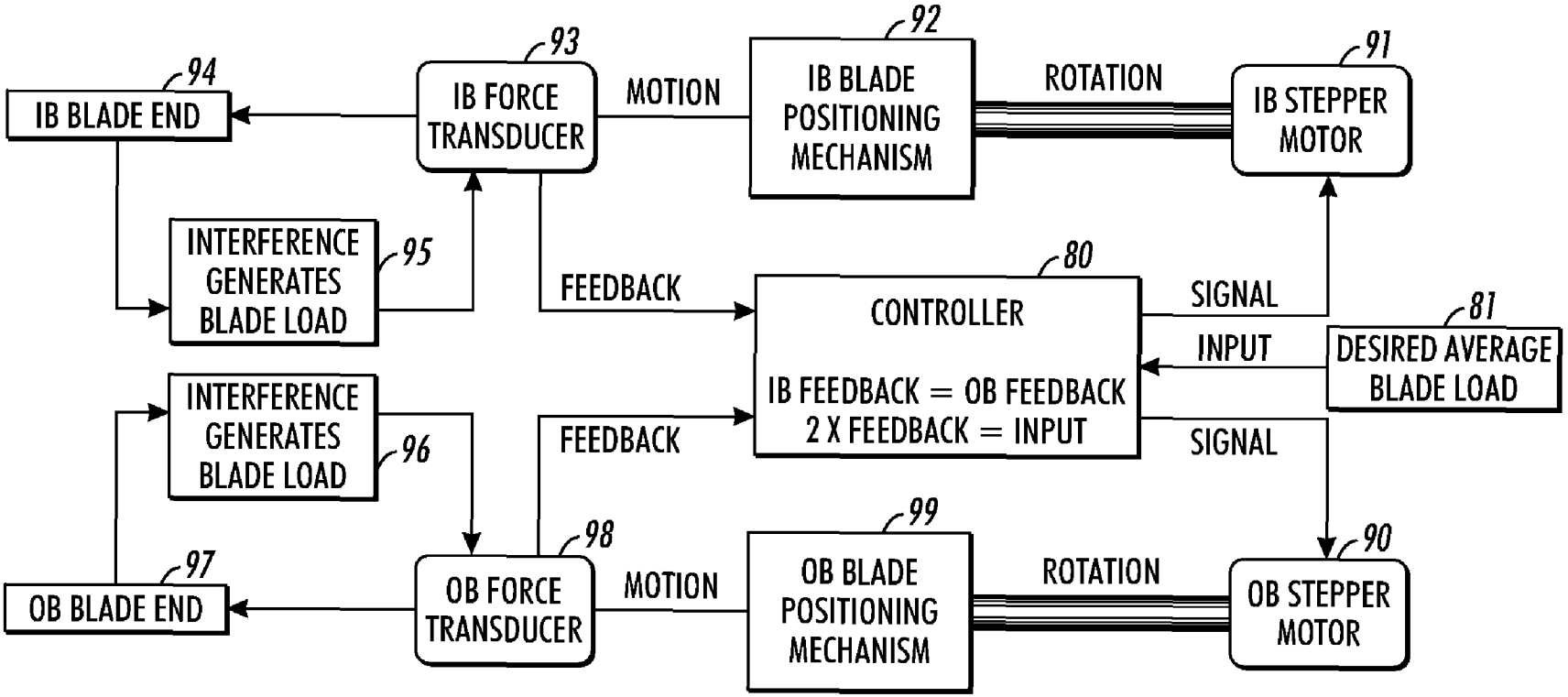
FIG. 7 is a schematic of a two force transducer system used to control blade load and blade alignment.

A schematic of an alternative cleaning performance control for the cleaning system of FIGS. 4 and 5 is shown in FIG. 7 for controlling blade load and blade alignment where a desired blade load at 81 is inputted into controller 80 which in turn send a signal to stepper motors 90 and 91 operatively connected in this example to inboard blade positioning mechanism 92 which is drivingly connected to inboard blade end 94 to thereby move cleaning blade 122. A force transducer 93 is positioned between inboard blade positioning mechanism inboard blade end 94 that measures the force applied to the inboard blade end 94 when it is rotated with respect to photoreceptor 112. Rotation of inboard blade positioning mechanism 92, which in this case is first link 160, by stepper motor 91 provides motion in block 94 to the inboard blade end of blade 122 and interference between the blade and photoreceptor against which the blade is loaded in block 95 generates force that is transmitted to inboard force transducer 93 which sends a signal representing the measured force to controller 80. Simultaneously, rotation of outboard blade positioning mechanism 99, by stepper motor 90 provides motion in block 97 to the outboard blade end of blade 122 and interference between the blade and photoreceptor against which the blade is loaded in block 96 generates force that is transmitted to outboard force transducer 74 which is positioned between the outboard blade positioning mechanism and outboard blade end 97. Outboard force transducer 98 sends a signal representing the measured force to controller 80. As mentioned heretofore, a small amount of clearance is intentionally introduced in the coupler link (blade holder 122) pins in order to be able to vary the interference on one end of the blade slightly from interference on the other end of the blade. By using this variation and a stepper motor and transducer on each end of the blade, independent adjustments of each blade end interference and thus blade load can be obtained. By independently adjusting the blade load measured by the two force transducers to half the predetermined blade load value the desired blade load is achieved and the blade is aligned to the photoreceptor surface by controller 80.

Alternatively, and at minimal cost, the cleaning efficiency of a blade cleaner could be accomplished by placing a camming mechanism into a cleaner blade holder to enable adjusting the normal force to the blade. The adjustment would be driven through a pixel counting algorithm. The pixel counting could be done in real-time by analyzing the image bit stream. If there is very low area coverage the blade would be cammed away slightly from the photoreceptor. A difference of 0.15 mm will be effective to reduce the friction force and avoid blade microtuck. If there is high area coverage, the cam would be in a direction to increase the force on the blade. An alternative feedback loop would be to sense the friction force on the blade, and adjust the force on the blade to keep the friction force constant.

It should be understood that while the variable interference cleaning blade system for reducing blade load and alignment variation mentioned hereinabove has been shown in a multi-blade system, it is adaptable and equally effective in a single blade cleaning system.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for sensing and adjusting cleaning blade load against a surface to be cleaned, comprising;

providing a surface to be cleaned;

providing at least one cleaning blade and positioned for cleaning said surface;

providing a first blade positioning mechanism drivingly connected to one end of said cleaning blade for moving said cleaning blade;

providing a first stepper motor drivingly connected to said first blade positioning mechanism for rotating said first blade positioning mechanism;

providing a first torque transducer positioned between said stepper motor and said first blade positioning mechanism;

actuating said first stepper motor and thereby move said cleaning blade to produce interference with said surface to be cleaned and generate blade load and torque with said torque being sent to said torque transducer;

providing a desired average blade load signal; and providing a controller for receiving said desired average blade load signal and a signal from said torque transducer and in turn sending a signal to actuate said first stepper motor to thereby rotate said cleaning blade against said surface to be cleaned to increase cleaning blade interference against said surface to be cleaned until feedback from said torque transducer is equal to said desired average blade load.

2. The method of claim 1, wherein said surface is a photoreceptor.

3. The method of claim 2, further providing a second blade positioning mechanism drivingly connected to the opposite end of said cleaning blade for rotating said cleaning blade.

4. The method of claim 3, further providing a second stepper motor drivingly connected to said second blade positioning mechanism for rotating said second blade positioning mechanism and thereby moving said cleaning blade.

5. The method of claim 4, further providing a second torque transducer positioned between said second stepper motor and said second blade positioning mechanism.

6. The method of claim 5, including simultaneously actuating said second stepper motor with said first stepper motor to thereby move the other end of said cleaning blade to produce interference with said surface to be cleaned and generate blade load and torque with said torque being sent to said torque transducer.

7. The method of claim 6, including aligning both ends of said cleaning blade with said photoreceptor surface by independently adjusting the blade load measured by said first and second torque transducers to half of the predetermined desired blade load value.

8. A method for adjusting cleaning blade load against a surface to be cleaned, comprising;

providing a surface to be cleaned;

providing at least one cleaning blade and positioned for cleaning said surface;

providing a first blade positioning mechanism drivingly connected to one end of said cleaning blade for moving said cleaning blade;

providing a first stepper motor drivingly connected to said first blade positioning mechanism for rotating said first blade positioning mechanism;

providing a first force transducer positioned between said first blade positioning mechanism and said one end of said cleaning blade;

actuating said first stepper motor to thereby move said cleaning blade to produce interference with said surface to be cleaned and generate blade load and force with said force being registered by said force transducer;

providing a desired average blade load signal; and providing a controller for receiving said desired average blade load signal and a signal from said force transducer and in turn sending a signal to actuate said first stepper motor to thereby move said cleaning blade against said surface to be cleaned to increase cleaning blade interference against said surface to be cleaned until feedback from said force transducer is equal to said desired average blade load.

9. The method of claim 8, wherein said surface is a photoreceptor.

10. The method of claim 9, further providing a second blade positioning mechanism drivingly connected to the opposite end of said cleaning blade for moving said cleaning blade.

11. The method of claim 10, further providing a second stepper motor drivingly connected to said second blade positioning mechanism for moving said second blade positioning mechanism and thereby said cleaning blade.

12. The method of claim 11, further providing a second force transducer positioned between said second blade positioning mechanism and the other end of said cleaning blade.

13. The method of claim 12, including simultaneously actuating said second stepper motor with said first stepper motor to thereby move the other end of said cleaning blade to produce interference with said surface to be cleaned and generate blade load and force with said force being sent to said force transducer.

14. The method of claim 13, including aligning both ends of said cleaning blade with said photoreceptor surface by independently adjusting the blade load measured by said first and second torque transducers to half of the predetermined desired blade load value.

15. A method for adjusting cleaning blade load and aligning the cleaning blade against a surface to be cleaned, comprising;

providing a surface to be cleaned;

providing at least one cleaning blade having an inboard end and an outboard end and positioned for cleaning said surface;

providing first and second blade positioning mechanisms with one each drivingly connected to said inboard and outboard ends of said cleaning blade for moving said cleaning blade;

providing a first and second stepper motors drivingly connected to said first and second blade positioning mechanisms for rotating said first and second blade positioning mechanisms;

providing first and second force transducers with one each of said first and second force transducers being positioned between said first and second blade positioning mechanisms and said inboard and outboard ends of said cleaning blade;

actuating said first and second stepper motors to thereby move said cleaning blade to produce interference with said surface to be cleaned and generate blade load and force with said force being registered by said force transducers;

providing a desired average blade load signal; and providing a controller for receiving said desired average blade load signal and a signal from said force transducers and in turn sending signals to actuate said first and second stepper motors to thereby move said inboard and outboard ends of said cleaning blade against said surface to be cleaned to increase cleaning blade interference against said surface to be cleaned until feedback from said force transducers is equal to said desired average blade load.

16. The method of claim 15, wherein said surface is a photoreceptor.

17. The method of claim 16, further providing multiple blades for cleaning said photoreceptor.

18. The method of claim 17, further providing a sensor for sensing detects accumulated blade use.

19. The method of claim 18, wherein said sensor is a counter.

20. The method of claim 19, wherein said counter measures blade use as a function of a number of prints.

* * * * *